US012759764B2

(12) United States Patent
Yi et al.

(10) Patent No.: US 12,759,764 B2
(45) Date of Patent: Oct. 13, 2026

(54) CONTENT CONTAINER

(71) Applicant: Kolmar Korea Co., Ltd., Sejong (KR)

(72) Inventors: Chang Soo Yi, Sejong (KR); Jong Hyun Park, Sejong (KR); Sang In Han, Sejong (KR); Hye Jin Jung, Sejong (KR); Sung Moo Choi, Sejong (KR)

(73) Assignee: Kolmar Korea Co., Ltd., Sejong (KR)

( * ) Notice: Subject to any disclaimer, the term of this patent is extended or adjusted under 35 U.S.C. 154(b) by 0 days.

(21) Appl. No.: 18/878,057

(22) PCT Filed: Feb. 27, 2023

(86) PCT No.: PCT/KR2023/002701
§ 371 (c)(1),
(2) Date: Dec. 22, 2024

(87) PCT Pub. No.: WO2023/249196
PCT Pub. Date: Dec. 28, 2023

(65) Prior Publication Data

US 2025/0242980 A1 Jul. 31, 2025

(30) Foreign Application Priority Data

Jun. 22, 2022 (KR) ..... 20-2022-0001534

(51) Int. Cl.
*B65D 43/16* (2006.01)
*B65D 25/18* (2006.01)
*B65D 51/28* (2006.01)

(52) U.S. Cl.
CPC ..... *B65D 43/16* (2013.01); *B65D 25/18* (2013.01); *B65D 51/28* (2013.01)

(58) Field of Classification Search
CPC ..... B65D 43/16; B65D 25/18; B65D 51/28; A45D 33/006; A45D 33/24; A45D 2200/051; A45D 2033/001
(Continued)

(56) References Cited

FOREIGN PATENT DOCUMENTS

JP 2016-222273 A 12/2016
KR 10-1354644 B1 1/2014
(Continued)

*Primary Examiner* — Jeffrey R Allen
*Assistant Examiner* — Elizabeth J Volz
(74) *Attorney, Agent, or Firm* — Bridgeway IP Law Group, PLLC; Sang Ho Lee; Hyun Woo Shin

(57) ABSTRACT

A content container includes an outer container having a first accommodation space formed therein; an inner container accommodated in the first accommodation space and having a second accommodation space formed therein; a shoulder part provided at an upper side of the outer container and having a communication space that is vertically penetrated formed therein to allow the inner container to be inserted; and a cover part configured to seal or open the communication space, wherein a base part is formed to protrude along an inner circumference of the shoulder part, a mounting part is formed to protrude along an outer circumference of the inner container, the inner container is accommodated in the first accommodation space of the outer container when the mounting part is mounted on an upper end of the base part, and when the cover part seals the communication space, mounting of the inner container is fixed and the second accommodation space is sealed.

9 Claims, 7 Drawing Sheets

(58) Field of Classification Search
USPC ..... 220/23.83, 810
See application file for complete search history.

(56) References Cited

FOREIGN PATENT DOCUMENTS

| | | | | | |
|---|---|---|---|---|---|
| KR | 101354644 | | * | 1/2014 | ..... A45D 4/00 |
| KR | 10-2021-0026794 | A | | 3/2021 | |
| KR | 10-2021-0154497 | A | | 12/2021 | |
| KR | 20210154497 | | * | 12/2021 | ..... A45D 4/00 |
| KR | 10-2386272 | B1 | | 4/2022 | |
| KR | 102386272 | | * | 4/2022 | ..... A45D 4/00 |
| KR | 20-0496167 | Y1 | | 11/2022 | |

* cited by examiner

CONTENT CONTAINER

TECHNICAL FIELD

The present disclosure relates to a content container.

BACKGROUND ART

Generally, a refill container is provided in the form of a double container made of an inner container and an outer container. The refill container provided in the form of the double container is refilled with contents by separating the inner container, from which contents are consumed, from the outer container and combining new contents to the outer container.

However, in order to separate the inner container from the outer container in a state in which the inner container and the outer container are firmly coupled, an inconvenient operation process for decoupling the firmly coupled inner container and outer container, such as rotating or pressing the inner container or outer container, is made necessary.

The inconvenient operation process for decoupling may be minimized by adjusting a coupling strength between the inner container and the outer container to be weak, but in this case, there are problems that the inner container may be easily detached from the outer container even when unintended by a user, and contents may leak to the outside due to a sealed state of the inner container easily being released.

DISCLOSURE

Technical Problem

The present disclosure is directed to providing a content container for addressing the above problems.

The technical objectives of the present disclosure are not limited to the above-mentioned objective, and other unmentioned objectives may become apparent to those of ordinary skill in the art from the following description.

Technical Solution

An embodiment of the present disclosure provides a content container. The content container comprises an outer container having a first accommodation space formed therein; an inner container accommodated in the first accommodation space and having a second accommodation space formed therein; a shoulder part provided at an upper side of the outer container and having a communication space that is vertically penetrated formed therein to allow the inner container to be inserted; and a cover part configured to seal or open the communication space, wherein a base part is formed to protrude along an inner circumference of the shoulder part, a mounting part is formed to protrude along an outer circumference of the inner container, the inner container is accommodated in the first accommodation space of the outer container when the mounting part is mounted on an upper end of the base part, and when the cover part seals the communication space, mounting of the inner container is fixed and the second accommodation space is sealed.

An inner support part and an outer support part may each protrude from an upper end of the shoulder part, an inner close contact part configured to come into close contact with an outer side of the inner support part and an outer close contact part configured to come into close contact with an inner side of the outer support part may each be formed on a lower end of the cover part, and when the cover part moves downward to seal the communication space, the sealing may be reinforced as an airtight space formed between the inner close contact part and the outer close contact part is compressed due to downward movement of the inner close contact part and the outer close contact part.

At least one first hooking part may be provided on an outer side of the outer support part of the shoulder part, at least one second hooking part that corresponds to the first hooking part may be provided on an inner side of the cover part, and the cover part may seal the shoulder part by a coupling between the first hooking part and the second hooking part.

The shoulder part may further comprise an outer edge part coupled to the outer container; an inner edge part provided at an inner side of the outer edge part and from which the base part extends inward; and a connecting part configured to connect the outer edge part and the inner edge part and have the inner support part and the outer support part formed on an upper end.

At least one pressing part configured to, when the cover part seals the communication space, press an upper end of the mounting part downward to fix and seal the inner container may protrude from the lower end of the cover part.

A downwardly curved part configured to be curved downward and extend from an outer end portion of the mounting part may be formed on the inner container, an upwardly curved part configured to be curved upward and extend from an inner end portion of the base part may be formed on the shoulder part, and when the inner container is mounted on the shoulder part, an inner surface of the downwardly curved part may be supported by an outer surface of the upwardly curved part.

The upwardly curved part may be spaced apart along an inner circumference of the base part, and an opening may be formed between a plurality of upwardly curved parts.

When a sealed state of the second accommodation space is released and contents accommodated in the second accommodation space leak, the contents may be introduced into the first accommodation space through the opening, and leakage of the contents to the outside may be prevented.

When the mounting part is mounted on the base part, air in the first accommodation space may be discharged to the outside through the opening, and an increase in an internal pressure of the first accommodation space may be addressed.

Advantageous Effects

According to the present disclosure, since an inner container can be attached or detached through a simple operation of mounting or detaching the inner container on or from a shoulder part, the inner container can be easily replaced, a refill operation can be easily performed, and the inner container can be firmly fixed after being replaced.

Also, according to the present disclosure, an inner container is fixed to a first accommodation space when a cover part seals a communication space, and the inner container can be prevented from easily being detached from an outer container.

Also, according to the present disclosure, an accommodation space inside an inner container is sealed when a cover part seals a communication space, and leakage of contents to the outside can be prevented.

Also, according to the present disclosure, as a cover part moves downward to seal a communication space, sealing can be gradually reinforced.

Also, according to the present disclosure, even when contents leak, since the contents are introduced into an accommodation space inside an outer container, the contents can be prevented from leaking to the outside.

In addition, according to the present disclosure, by allowing air in an accommodation space inside an outer container to be discharged to the outside when an inner container is mounted on the outer container, an increase in an internal pressure can be addressed.

DESCRIPTION OF DRAWINGS

A brief description of each drawing will be provided for better understanding of the drawings referenced in the detailed description of the present disclosure.

MODES OF THE INVENTION

Figure 1:
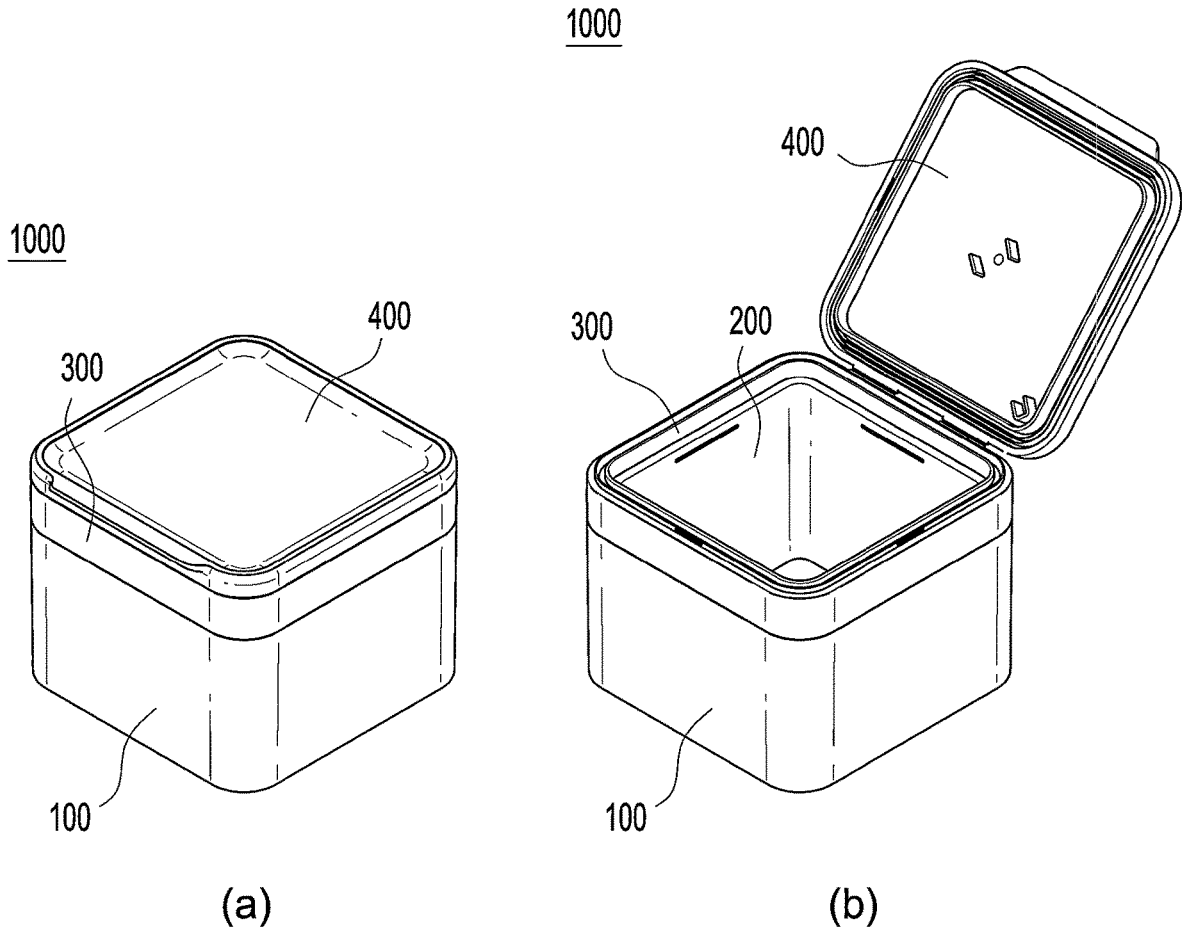
FIG. 1 is a perspective view of a content container according to an embodiment of the present disclosure.

Hereinafter, exemplary embodiments according to the present disclosure will be described in detail with reference to the accompanying drawings. Also, methods of configuring and using a device according to the embodiments of the present disclosure will be described in detail with reference to the accompanying drawings. The same reference numeral or symbol throughout the drawings indicates a component or element that performs substantially the same function. For convenience of description, directions such as vertical and horizontal mentioned herein are based on the drawings, and the scope of rights of the present disclosure is not necessarily limited by the corresponding directions.

Terms including ordinals such as "first" and "second" may be used to describe various elements, but the elements are not limited by the terms. The terms are only used for the purpose of distinguishing one element from another element. For example, without departing from the scope of rights of the present disclosure, a first element may be referred to as a second element, and likewise, a second element may be referred to as a first element. The term "and/or" comprises a combination of a plurality of related items or any one item among the plurality of related items.

Terms used herein are used to describe embodiments and are not intended to limit and/or restrict the present disclosure. A singular expression comprises a plural expression unless the context clearly indicates otherwise. In the specification, terms such as "comprise" or "have" should be understood as specifying that features, numbers, steps, operations, elements, components, or combinations thereof are present and not as precluding the possibility of the presence or addition of one or more other features, numbers, steps, operations, elements, components, or combinations thereof in advance.

Throughout the specification, when a certain part is described as being connected to another part, this not only comprises a case in which the certain part is directly connected to the other part but also comprises a case in which the certain part is indirectly connected to the other part with another configuration disposed therebetween. Also, when a certain part is described as comprising a certain element, this signifies that the certain part may further comprise other elements rather than excluding other elements unless particularly described otherwise.

Figure 2:
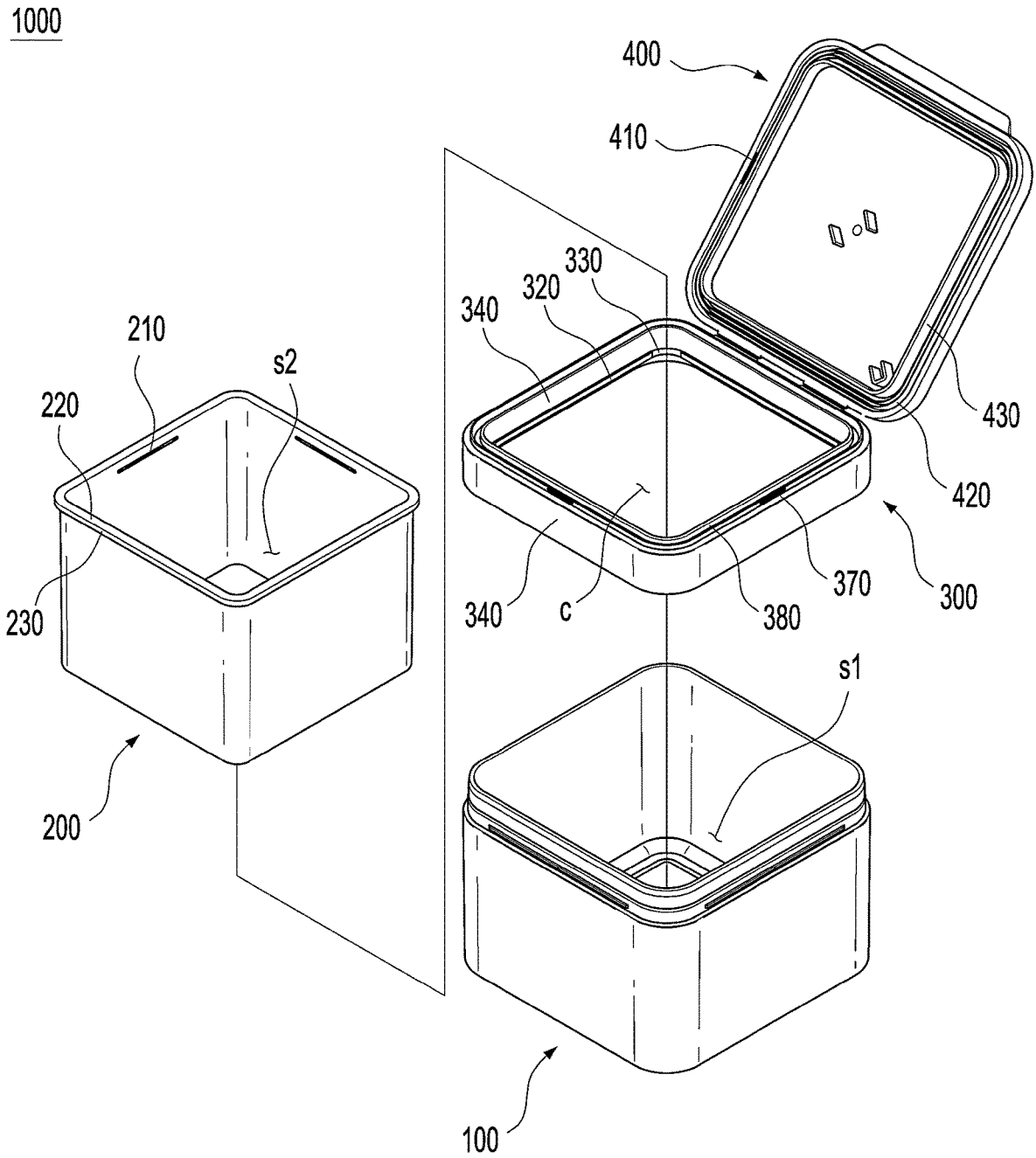
FIG. 2 is an exploded perspective view of the content container according to an embodiment of the present disclosure.
Figure 3:
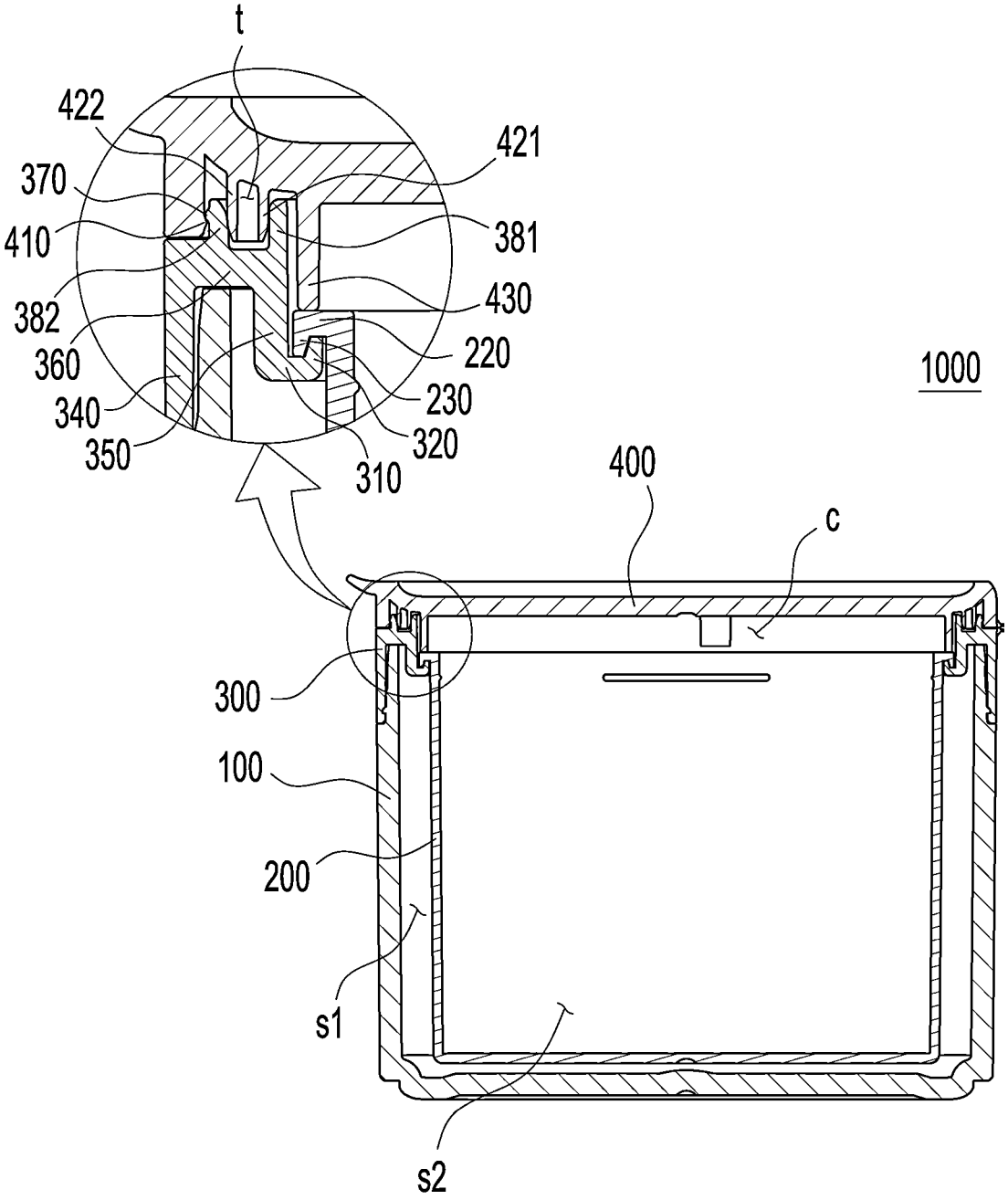
FIG. 3 is a cross-sectional view of the content container according to an embodiment of the present disclosure.

FIG. 1 is a perspective view of a content container according to an embodiment of the present disclosure, FIG. 2 is an exploded perspective view of the content container according to an embodiment of the present disclosure, and FIG. 3 is a cross-sectional view of the content container according to an embodiment of the present disclosure.

Referring to FIGS. 1 to 3, a content container 1000 may comprise an outer container 100, an inner container 200, a shoulder part 300, and a cover part 400.

The outer container 100 may have a first accommodation space s1 formed therein. The inner container 200 may be accommodated in the first accommodation space s1. For example, the outer container 100 may be a box-shaped container having an open top so that the first accommodation space s1 is formed therein, but this is only illustrative, and various other embodiments, in which a side surface of the outer container 100 is open or both a top and a bottom of the outer container 100 are open, may be applied.

The inner container 200 may be accommodated in the first accommodation space s1 and may have a second accommodation space s2 formed therein. Contents may be accommodated in the second accommodation space s2. For example, any of various known types of containers such as a bottle, a jar, a tube, and a pouch may be freely selected as the inner container 200 having the second accommodation space s2 formed therein.

In an embodiment, the contents may be a cosmetic material in the form of a liquid, gel, or powder. Examples of the contents may comprise a lotion, a milk lotion, a moisturizing lotion, a nourishing lotion, a skin lotion, a skin softener, a skin toner, an astringent, a massage cream, a nourishing cream, a moisturizing cream, a skin lightening essence, a tone up cream, a liquid sunscreen, sunblock, sun milk, a blemish balm (BB) cream, a base, a foundation, a color correcting (CC) cream, concealer, blusher, contour powder, an eye shadow, an eyebrow pencil, an eye cream, a primer, and the like. However, the contents are not limited thereto, and other formulations or types of cosmetic materials, medical contents, and the like may be applied.

In an embodiment, the contents may be impregnated in an impregnation member made of a nonwoven fabric, a sponge, or the like and then may be accommodated in the second accommodation space s2. However, this is only illustrative, and various other embodiments, in which the contents are directly accommodated in the second accommodation space s2 or accommodated in the second accommodation space s2 while accommodated in a cosmetic palette, may be applied.

In an embodiment, at least one detachment preventing protrusion 210 may be provided on an upper end of an inner side of the inner container 200. The detachment preventing protrusion 210 may determine a height of the impregnation member stacked in the second accommodation space s2 and may restrict detachment of the impregnation member to the outside of the second accommodation space s2.

The shoulder part 300 may be provided at an upper side of the outer container 100 and may have a communication space c that is vertically penetrated formed therein. The inner container 200 may be inserted or separated through the communication space c.

In an embodiment, when the inner container 200 is inserted into the communication space c, and the inner container 200 is mounted on the shoulder part 300, the inner container 200 may be accommodated in the first accommodation space s1 while spaced apart from a bottom surface of the outer container 100.

In an embodiment, a base part 310 may be formed to protrude (inward) along an inner circumference of the shoulder part 300, and a mounting part 220 may be formed to protrude (outward) along an outer circumference of the inner container 200. The mounting part 220 may be mounted on an upper end of the base part 310. When the mounting part 220 is mounted on the upper end of the base part 310, the inner container 200 may be accommodated in the first accommodation space s1 while spaced apart from the bottom surface of the outer container 100. In addition, when the mounting part 220 is detached from the upper end of the base part 310, the inner container 200 may be separated from the outer container 100.

In an embodiment, an upwardly curved part 320 configured to be curved upward and extend from an inner end portion of the base part 310 may be formed on the shoulder part 300, and a downwardly curved part 230 configured to be curved downward and extend from an outer end portion of the mounting part 220 may be formed on the inner container 200. When the inner container 200 is mounted on the shoulder part 300 (that is, when the mounting part 220 is mounted on the base part 310), an inner surface of the downwardly curved part 230 may be supported by an outer surface of the upwardly curved part 320, and the inner container 200 may be more stably and firmly mounted.

In an embodiment, the upwardly curved part 320 may be formed along an inner circumference of the base part 310, and a plurality of upwardly curved parts 320 may be spaced apart from each other. An opening 330 may be formed between the plurality of upwardly curved parts 320.

In an embodiment, the opening 330 may prevent external leakage of contents. For example, when a sealed state of the second accommodation space s2 is released and contents accommodated in the second accommodation space s2 leak, the contents may be introduced into the first accommodation space s1 through the opening 330. That is, the leaking contents may be introduced into the first accommodation space s1 and may not leak to the outside.

In addition, an inclined surface that is gradually inclined downward toward the opening 330 may be formed on the base part 310. The leaking contents may move along the inclined surface and move toward the opening 330.

In an embodiment, the opening 330 may address an increase in an internal pressure of the first accommodation space s1 when the inner container 200 is mounted. For example, when the inner container 200 is mounted on the shoulder part 300 (that is, when the mounting part 220 is mounted on the base part 310), air in the first accommodation space s1 may be discharged to the outside through the opening 330, and accordingly, an increase in the internal pressure of the first accommodation space s1 may be addressed. In addition, a fluid flow toward the opening 330 may be generated inside the first accommodation space s1, and insertion of the inner container 200 into the first accommodation space s1 may be guided.

In an embodiment, the shoulder part 300 may comprise an outer edge part 340, an inner edge part 350 provided at an inner side of the outer edge part 340, and a connecting part 360 configured to connect the outer edge part 340 and the inner edge part 350. For example, the outer edge part 340 may be coupled to the outer container 100, and the base part 310 may extend inward from the inner edge part 350. For example, at least one screw thread and/or fitting protrusion may be provided on an outer side of the outer edge part 340 and may be screw-coupled and/or fitted to the outer container 100, but the present disclosure is not limited thereto, and various other coupling methods such as hooking, inserting, and hanging may be applied.

The cover part 400 may seal or open the communication space c of the shoulder part 300. Specifically, the cover part 400 may be rotatably coupled to one side of the shoulder part 300 and may seal or open the communication space c by rotating. For example, various coupling methods for implementing rotatable coupling, such as the cover part 400 and the shoulder part 300 being connected by at least one hinge part, may be applied. Here, sealing of the communication space c may be achieved by the cover part 400 being hooked to the shoulder part 300 in a state in which the cover part 400 is rotated to perform sealing at the shoulder part 300.

However, this is only illustrative, and according to embodiments, the cover part 400 may be coupled to be attachable to and detachable from the shoulder part 300, and the communication space c may be sealed or opened as the cover part 400 is coupled to or separated from the shoulder part 300. For example, various coupling methods for implementing attachable/detachable coupling, such as the cover part 400 and the shoulder part 300 being screw-coupled by one or more screw threads corresponding to each other or being fitted by one or more fitting protrusions corresponding to each other, may be applied.

In an embodiment, at least one first hooking part 370 may be provided at the shoulder part 300, and at least one second hooking part 410 that corresponds to the first hooking part 370 may be provided at the cover part 400. The cover part 400 may seal the communication space c by coupling between the first hooking part 370 and the second hooking part 410. For example, the first hooking part 370 may be provided at an outer side of a support part (particularly, an outer support part 390) of the shoulder part 300, and the second hooking part 410 may be provided at an inner side of the cover part 400.

In an embodiment, at least one support part 380 may protrude from an upper end of the shoulder part 300, particularly an upper end of the connecting part 360, and at least one close contact part 420 configured to come into close contact with the support part 380 may be formed on a lower end of the cover part 400. Sealing of the communication space c by the cover part 400 may be assisted and/or reinforced as the close contact part 420 comes into close contact with the support part 380.

In an embodiment, the support part 380 may comprise an inner support part 381 and an outer support part 382, and the close contact part 420 may comprise an inner close contact part 421 and an outer close contact part 422. Here, the inner close contact part 421 may come into close contact with an outer side of the inner support part 381, and the outer close contact part 422 may come into close contact with an inner side of the outer support part 382. Due to the close contact thereof, an airtight space t may be formed between the inner close contact part 421 and the outer close contact part 422.

In an embodiment, when the cover part 400 moves downward to seal the communication space c, sealing of the communication space c by the cover part 400 may be reinforced due to the airtight space t being compressed. Specifically, as the inner close contact part 421 and the outer close contact part 422 move downward, the airtight space t may be sealed from the outside and compressed. When the airtight space t is compressed, an internal pressure of the airtight space t increases, and due to the increase in the internal pressure, the inner close contact part 421 may be pressed inward, and the outer close contact part 422 may be pressed outward. Due to the inner close contact part 421 and the outer close contact part 422 being pressed in such a manner, the close contact between the inner close contact part 421 and the inner support part 381 and the close contact between the outer close contact part 422 and the outer support part 382 may be reinforced, and accordingly, sealing of the communication space c by the cover part 400 may be reinforced.

In an embodiment, when the cover part 400 seals the communication space c, the inner container 200 may be fixed to the first accommodation space s1, and the second accommodation space s2 may be sealed. To this end, for example, at least one pressing part 430 may protrude from the lower end of the cover part 400. The pressing part 430 may fix and seal the inner container 200 by pressing an upper end of the inner container 200, especially the mounting part 220, downward when the cover part 400 seals the communication space c.

In an embodiment, it may be possible to stack a plurality of content containers 1000. To this end, for example, at least one region of an upper end of the cover part 400 may be recessed to correspond to the shape of a lower end of the outer container 100. Accordingly, the lower end of the outer container 100 of a second content container may be inserted into the recessed region of the upper end of the cover part 400 of a first content container, and the second content container may be stacked on an upper end of the first content container.

The content container 1000 according to FIGS. 1 to 3 is only illustrative, and various other configurations may be applied according to embodiments to which the present disclosure is applied.

Figure 4:
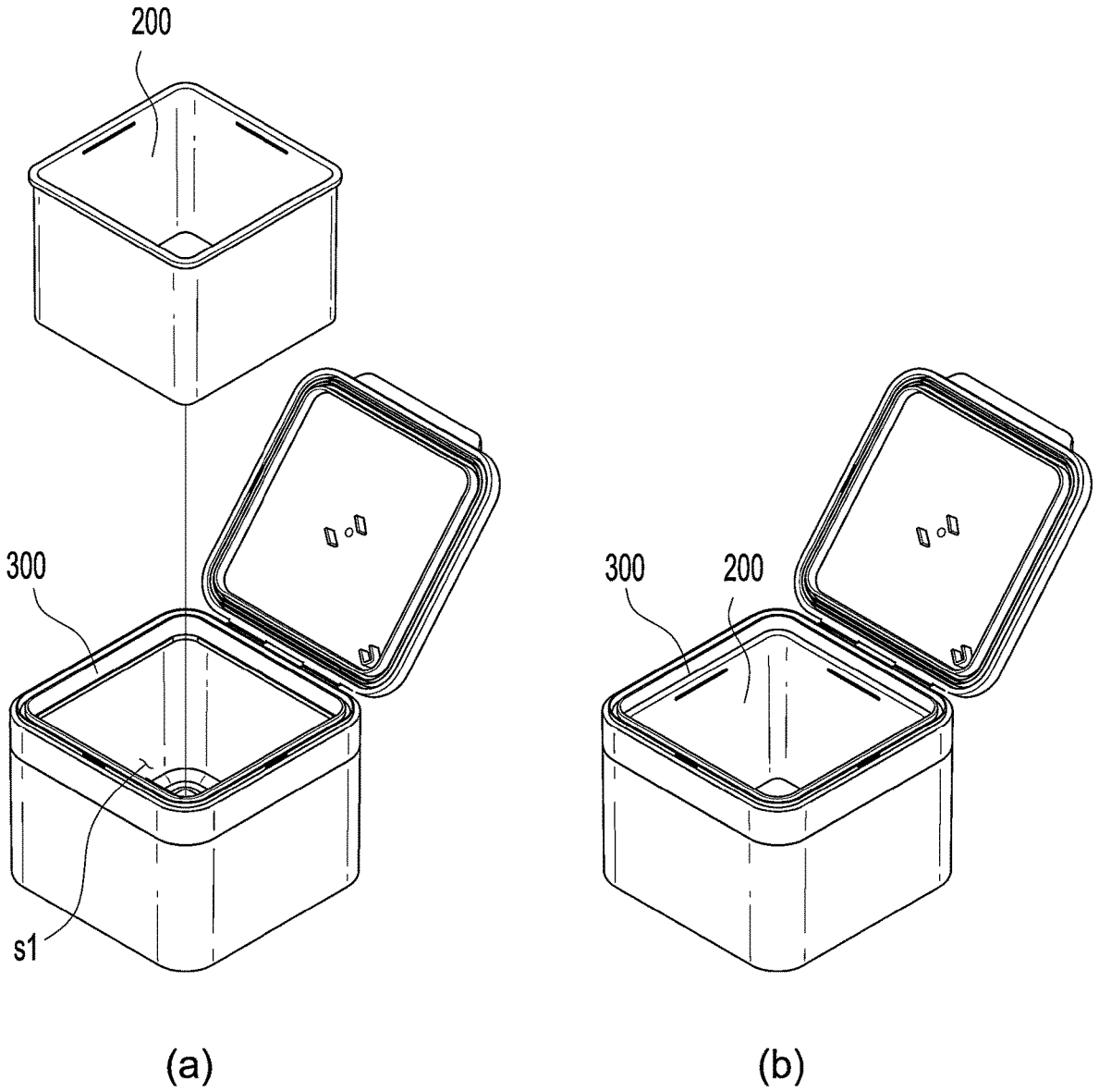
FIG. 4 is a view for describing an operation of coupling an inner container according to an embodiment of the present disclosure.

FIG. 4 is a view for describing an operation of coupling an inner container according to an embodiment of the present disclosure.

Referring to FIG. 4, the inner container 200 may be inserted into the first accommodation space s1 through the communication space c inside the shoulder part 300. In a process in which the inner container 200 is inserted into the first accommodation space s1, air inside the first accommodation space s1 may be discharged to the outside through the opening 330, and accordingly, an increase in the internal pressure of the first accommodation space s1 may be addressed. In addition, a fluid flow toward the opening 330 may be generated inside the first accommodation space s1, and insertion of the inner container 200 into the first accommodation space s1 may be guided.

When the inner container 200 is completely inserted into the first accommodation space s1, the inner container 200 may be mounted on the shoulder part 300 and accommodated in the first accommodation space s1 while spaced apart from the bottom surface of the outer container 100. Specifically, the inner container 200 may be mounted on the shoulder part 300 by the mounting part 220 being mounted on the base part 310. Here, an inner peripheral surface of the downwardly curved part 230 on an outer side of the mounting part 220 may be supported by an outer peripheral surface of the upwardly curved part 320 on an inner side of the base part 310.

The operation of coupling the inner container 200 according to FIG. 4 is only illustrative, and various other methods may be applied according to embodiments to which the present disclosure is applied.

Figure 5:
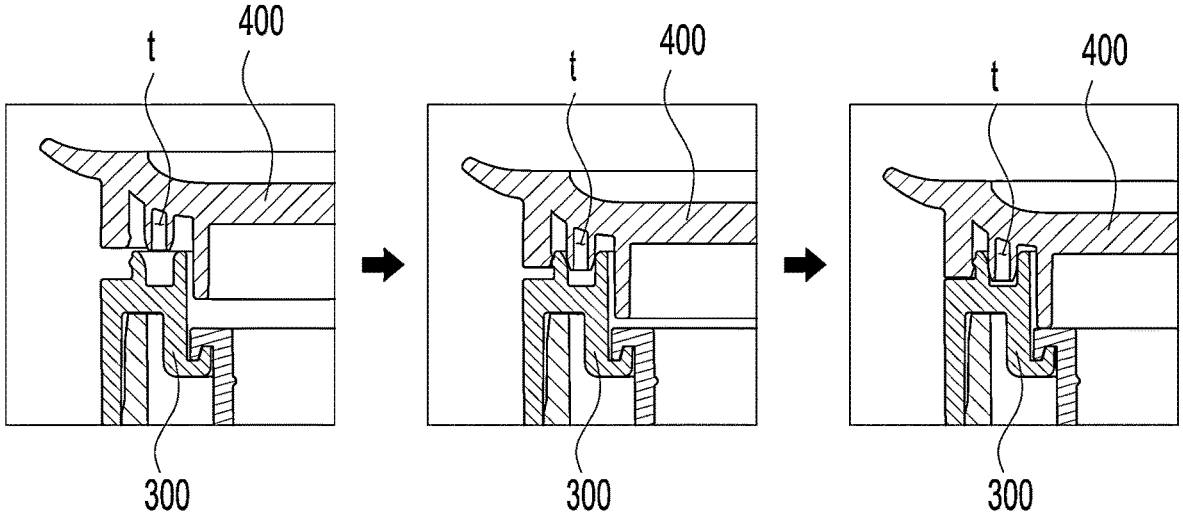
FIG. 5 is a view for describing a sealing operation of a cover part according to an embodiment of the present disclosure.

FIG. 5 is a view for describing a sealing operation of a cover part according to an embodiment of the present disclosure.

Referring to FIG. 5, when the cover part 400 moves downward to seal the communication space c, as the inner close contact part 421 and the outer close contact part 422 move downward, the airtight space t formed between the inner close contact part 421 and the outer close contact part 422 may be sealed from the outside and compressed. When the airtight space t is compressed, an internal pressure of the airtight space t increases, and due to the increase in the internal pressure, the inner close contact part 421 may be pressed inward, and the outer close contact part 422 may be pressed outward. Due to the inner close contact part 421 and the outer close contact part 422 being pressed in such a manner, the close contact between the inner close contact part 421 and the inner support part 381 and the close contact between the outer close contact part 422 and the outer support part 382 may be reinforced, and accordingly, sealing of the communication space c by the cover part 400 may be reinforced.

When the cover part 400 completely moves downward, sealing of the communication space c may be achieved by the first hooking part 370 and the second hooking part 410 being coupled.

The sealing operation of the cover part 400 according to FIG. 5 is only illustrative, and various other methods may be applied according to embodiments to which the present disclosure is applied.

Figure 6:
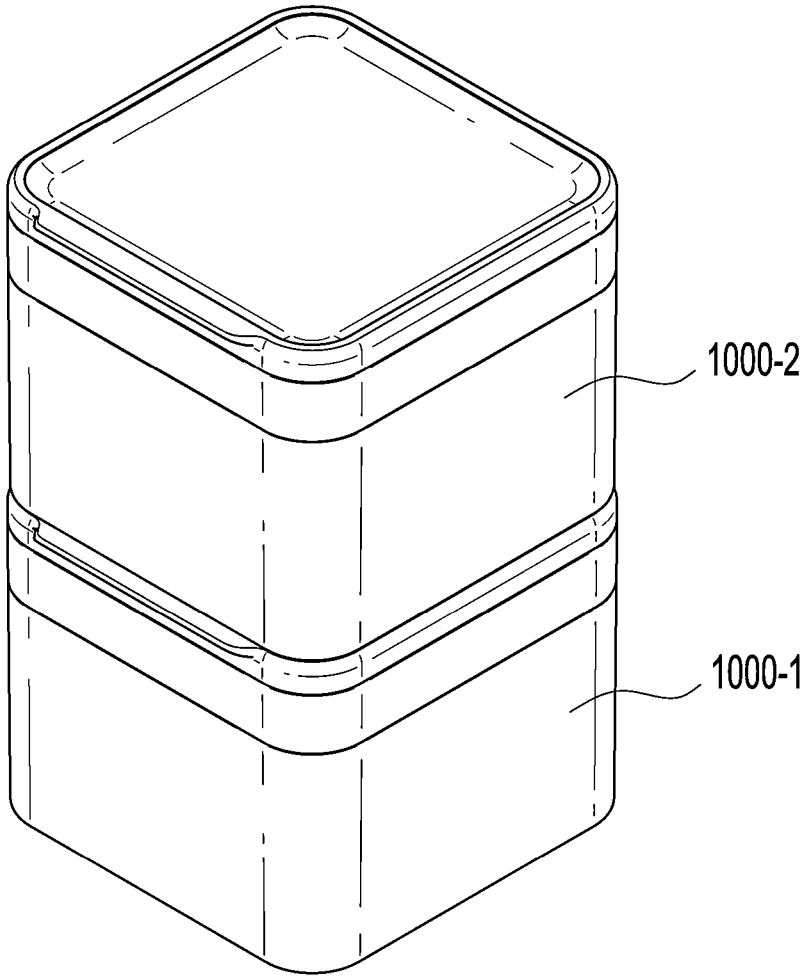
FIG. 6 is a view for describing stacking of content containers according to an embodiment of the present disclosure.

FIG. 6 is a view for describing stacking of content containers according to an embodiment of the present disclosure.

Referring to FIG. 6, content containers 1000 may comprise a first content container 1000-1 and a second content container 1000-2, and the second content container 1000-2 may be stacked on an upper end of the first content container 1000-1. At this time, at least one region of an upper end of the cover part 400 of the first content container 1000-1 may be recessed to correspond to the shape of the lower end of the outer container 100 of the second content container 1000-2, and here, as the lower end of the outer container 100 of the second content container 1000-2 is inserted into the recessed region of the upper end of the cover part 400 of the first content container 1000-1, the second content container 1000-2 may be stacked on the upper end of the first content container 1000-1. With the same principle, a plurality of content containers 1000 may be further stacked on an upper end of the second content container 1000-2.

Stacking of the content containers 1000 according to FIG. 6 is only illustrative, and various other methods may be applied according to embodiments to which the present disclosure is applied.

Figure 7:
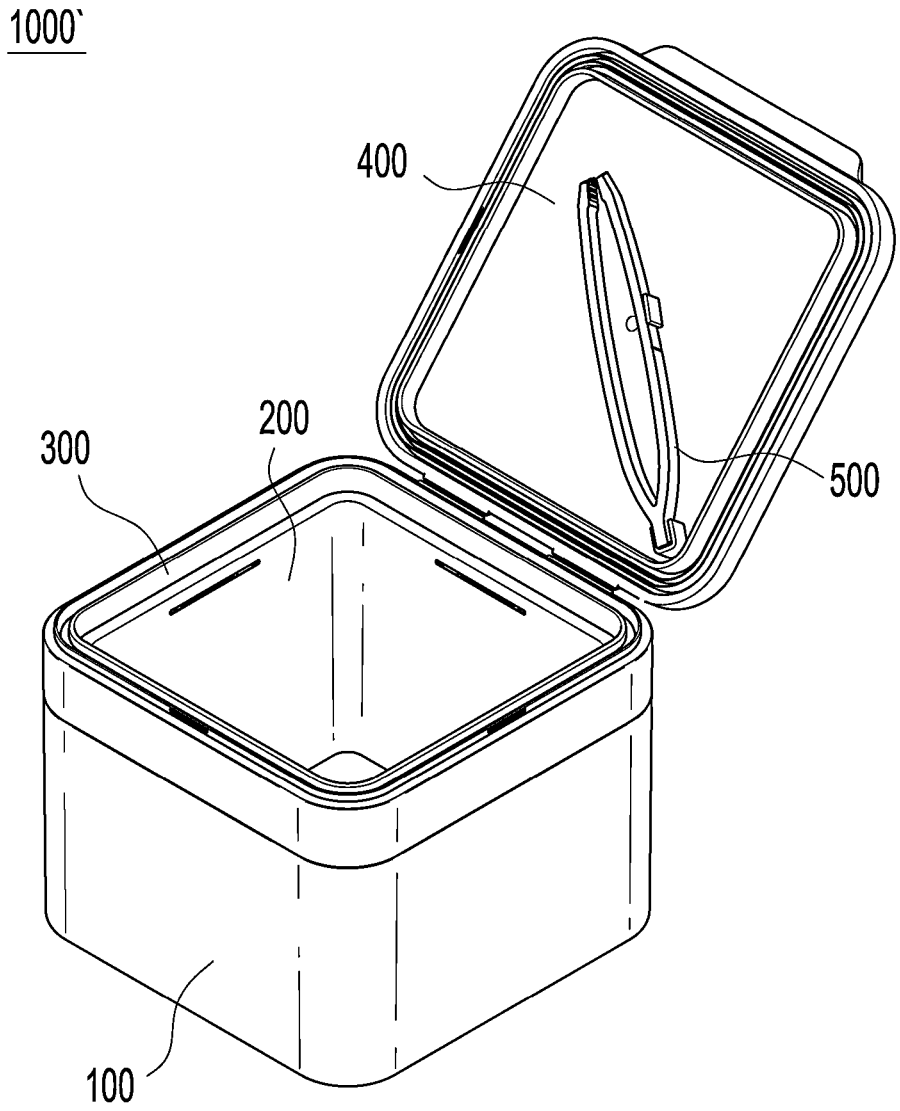
FIG. 7 is a perspective view of a content container according to an embodiment of the present disclosure.

FIG. 7 is a perspective view of a content container according to an embodiment of the present disclosure.

Referring to FIG. 7, a content container 1000' may comprise an outer container 100, an inner container 200, a shoulder part 300, a cover part 400, and a cosmetic tool 500. Here, the outer container 100, the inner container 200, the shoulder part 300, and the cover part 400 are the same as those described above with reference to FIGS. 1 to 5.

The cosmetic tool 500 is a tool for using contents accommodated in the second accommodation space s2. For example, the cosmetic tool 500 may be selected from various cosmetic tools such as tweezers for picking up an impregnation member, a spatula for applying contents, and a pipette for sucking contents.

In an embodiment, the cosmetic tool 500 may be stored at a lower end of the cover part 400. To this end, for example, at least one storage space for accommodating the cosmetic tool 500 may be formed at the lower end of the cover part 400. The storage space may be formed by at least one storage protrusion protruding from the lower end of the cover part 400 or by at least one region of the lower end of the cover part 400 being recessed.

The content container 1000' according to FIG. 7 is only illustrative, and various other configurations may be applied according to embodiments to which the present disclosure is applied.

As described above, optimal embodiments have been disclosed in the drawings and the specification. Although specific terms have been used herein, these are only intended to describe the present disclosure and are not intended to limit the meanings of the present disclosure or the scope of the present disclosure disclosed in the claims. Therefore, those skilled in the art will appreciate that various modifications and equivalent other embodiments are possible from the above embodiments. Therefore, the scope of the present disclosure should be defined by the technical spirit of the accompanying claims.

The invention claimed is:

1. A content container comprising:

an outer container having a first accommodation space defined therein;

an inner container accommodated within the first accommodation space and having a second accommodation space defined therein;

a shoulder part disposed on a first end of the outer container where the first accommodation space is defined, the shoulder part having a communication space that is vertically penetrated defined therein to allow the inner container to be inserted; and a cover part configured to seal or open the communication space, wherein a base part protrudes along an inner circumference of the shoulder part, and a mounting part protrudes along an outer circumference of the inner container, wherein the inner container includes a downwardly curved part extending downward from an outer end portion of the mounting part, wherein the shoulder part includes at least one upwardly curved part extending upward from an inner end portion of the base part, and wherein the at least one upwardly curved part includes a plurality of upwardly curved parts spaced apart along an inner circumference of the base part, and at least one opening defined between the plurality of upwardly curved parts.

2. The content container of claim 1, wherein:

an inner support part and an outer support part each protrude from an upper end of the shoulder part;

an inner close contact part configured to come into close contact with an outer side of the inner support part and an outer close contact part configured to come into close contact with an inner side of the outer support part are each formed on a lower end of the cover part; and when the cover part moves downward to seal the communication space, the sealing is reinforced as an airtight space formed between the inner close contact part and the outer close contact part is compressed due to downward movement of the inner close contact part and the outer close contact part.

3. The content container of claim 2, wherein:

at least one first hooking part is disposed on an outer side of the outer support part of the shoulder part, at least one second hooking part that corresponding to the at least one first hooking part is disposed on an inner side of the cover part; and the cover part seals the shoulder part by a coupling between the at least one first hooking part and the at least one second hooking part.

4. The content container of claim 2, wherein the shoulder part further comprises an outer edge part coupled to the outer container;

an inner edge part provided at an inner side of the outer edge part and from which the base part extends inward; and a connecting part configured to connect the outer edge part and the inner edge part and have the inner support part and the outer support part formed on an upper end.

5. The content container of claim 1, wherein at least one pressing part configured to, when the cover part seals the communication space, press an upper end of the mounting part downward to fix and seal the inner container protrudes from a lower end of the cover part.

6. The content container of claim 1, wherein when the inner container is mounted on the shoulder part, an inner surface of the downwardly curved part is supported by an outer surface of the at least one upwardly curved part.

7. The content container of claim 6, wherein, when a sealed state of the second accommodation space is released and contents accommodated in the second accommodation space leak, the contents are introduced into the first accommodation space through the at least one opening, and leakage of the contents to an outside is prevented.

8. The content container of claim 6, wherein, when the mounting part is mounted on the base part, air in the first accommodation space is discharged to an outside through the at least one opening, and an increase in an internal pressure of the first accommodation space is addressed.

9. The content container of claim 1, wherein the inner container is accommodated in the first accommodation space of the outer container when the mounting part is mounted on an upper end of the base part, and when the cover part seals the communication space, mounting of the inner container is fixed and the second accommodation space is sealed.

* * * * *